US007263804B2

(12) United States Patent
Ishii et al.

(10) Patent No.: US 7,263,804 B2
(45) Date of Patent: Sep. 4, 2007

(54) VEHICLE DOOR WINDOW UNIT FOR RAISING AND LOWERING A WINDOW HAVING A CABLE TENSIONER FOR MAINTAINING TENSION IN SUPPORT CABLES

(75) Inventors: Koji Ishii, Nagoya (JP); Shinichi Nishikawa, Nagoya (JP); Takashi Nishio, Nagoya (JP); Yoshihiro Ando, Nagoya (JP)

(73) Assignee: Kabushikikaisha Ansei (JP)

( * ) Notice: Subject to any disclaimer, the term of this patent is extended or adjusted under 35 U.S.C. 154(b) by 0 days.

(21) Appl. No.: 10/986,667

(22) Filed: Nov. 12, 2004

(65) Prior Publication Data

US 2005/0081448 A1 Apr. 21, 2005

Related U.S. Application Data

(62) Division of application No. 10/724,078, filed on Dec. 1, 2003, now Pat. No. 7,104,009, which is a division of application No. 10/188,334, filed on Jul. 3, 2002, now Pat. No. 7,234,274.

(30) Foreign Application Priority Data

| | | |
|---|---|---|
| Jul. 10, 2001 | (JP) | 2001-209572 |
| Aug. 6, 2001 | (JP) | 2001-238130 |
| Sep. 28, 2001 | (JP) | 2001-299842 |

(51) Int. Cl.
*E05F 11/48* (2006.01)

(52) U.S. Cl. ..... 49/352; 49/349; 49/502

(58) Field of Classification Search ..... 49/352, 49/349, 348, 374, 502
See application file for complete search history.

(56) References Cited

U.S. PATENT DOCUMENTS

| | | | | |
|---|---|---|---|---|
| 5,074,077 | A * | 12/1991 | Toyoshima et al. | 49/352 |
| 5,617,675 | A * | 4/1997 | Kobrehel | 49/352 |
| 5,778,600 | A * | 7/1998 | Chu | 49/352 |
| 6,074,077 | A * | 6/2000 | Pastrick et al. | 362/494 |
| 6,161,337 | A * | 12/2000 | Morando | 49/352 |
| 6,397,524 | B1 * | 6/2002 | Sakaguchi et al. | 49/375 |
| 6,758,013 | B2 * | 7/2004 | Staser et al. | 49/352 |

FOREIGN PATENT DOCUMENTS

JP 2001-001756 1/2001

* cited by examiner

*Primary Examiner*—Gregory J. Strimbu
(74) *Attorney, Agent, or Firm*—Connolly Bove Lodge & Hutz LLP

(57) ABSTRACT

A vehicle door, wherein a drive unit for raising and lowering a glass plate is constructed so that a plurality of pulleys across which wires are laid are provided at upper and lower sides of a base panel. The glass plate is moved up and down by driving the wires, and the glass plate is prevented from moving in a vehicle inward direction when the door is closed. Wire fixing portions are prevented from being damaged by large upward and downward stroke movements of the glass plate Furthermore, the wires are prevented from slackening when the wires are driven and stopped by providing a supporting rod along a path of upward and downward movement of the glass plate, and a contact member which has no contact with the supporting rod. Trumpet-shaped guide portions are provided at hole edges of the wire fixing portions, and the V-shaped circumferential surfaces of a tensioner eliminates slack in the wires.

2 Claims, 10 Drawing Sheets

BACKGROUND ART

BACKGROUND ART

VEHICLE DOOR WINDOW UNIT FOR RAISING AND LOWERING A WINDOW HAVING A CABLE TENSIONER FOR MAINTAINING TENSION IN SUPPORT CABLES

This application is a divisional of U.S. patent application Ser. No. 10/724,078, filed Dec. 1, 2003, now U.S. Pat. No. 7,104,009 which is a divisional of U.S. patent application Ser. No. 10/188,334, filed Jul. 3, 2002 now U.S. Pat. No. 7,234,274.

FIELD OF THE INVENTION

The present invention relates to a vehicle door, wherein a glass plate which is provided in a window in an upwardly and downwardly movable manner is supported by two window frames provided at the front side and rear side of the window.

BACKGROUND OF THE INVENTION

As examples of a conventionally known vehicle door, there are a hinge door and a slide door (for example, refer to Japanese Unexamined Patent Publication No. 2001-1756). An example of a conventional hinge door is described in FIG. 9.

The vehicle door 1' comprises a door panel unit and a door module. The door panel unit comprises an outer panel 13' forming an outer wall of the door 1', a hinge member 1'*a* for attaching the door 1' to the vehicle body, and an inner panel provided at a vehicle inner circumferential edge of the outer panel 13'.

On the other hand, a frame structure forming the framework of the door module comprises a front sash 6'*a* positioned at a vehicle front side, a rear sash 6'*b* positioned at a vehicle rear side, an upper sash 6'*c* positioned at the highest portion of the door module, a middle frame 6'*d* that is positioned below the upper sash 6'*c* and extends horizontally, and a window 5' enclosed by these sashes, and further comprises a panel 3' including a lower frame 6'*e* positioned at the lowest portion of the middle frame 6'*d* and door module and a space 4' therebetween. The upper sash 6'*c* is along an upper edge 10'*a* of the door glass 10'.

The frame structure comprises a drive unit 20' for driving the glass plate up and down, a door latch mechanism, and a latching operation mechanism (door inside handle).

The sashes 6'*a*, 6'*b*, and 6'*c*, drive unit 20', and door glass 10' compose a door glass lifting and lowering device.

As shown in FIG. 9, the drive unit 2O' comprises a steel-made base plate (referred to as a base panel, also) 21' provided between the middle frame 6'*d* and lower frame 6'*e*, and a pair of front and rear frames 22' and 23' that are fixed on the base plate 21' and extend vertically. Upper ends and lower ends of the frames 22' and 23' are fixed to the middle frame 6'*d* and the lower frame 6'*e*. Upper pulleys 26' and 28' and lower pulleys 27' and 29' are provided at the upper ends and lower ends of the frames 22' and 23'. Furthermore, a drive pulley 25' and a motor 24' for rotating the drive pulley 25' are provided on the base plate 21'. This motor 24' is a motor with a reduction gear, which uses an on-vehicle battery (not shown) as a power supply and is rotatable forward and backward.

A wire called a wire cable is set on these pulleys so as to cross over in an X shape. Namely, this wire comprises a front moving portion 31'*a* laid vertically across the front side upper pulley 28' and lower pulley 27', a rear moving portion 31'*b* laid vertically across the rear side upper pulley 28' and lower pulley 29', a first slanting portion 31'*c* slantingly laid across the upper pulley 28' and drive pulley 25', a second slanting portion 31'*d* slantingly laid across the lower pulley 27' and drive pulley 25', and a third slanting portion 31'*e* slantingly laid across the upper pulley 26' and lower pulley 29'.

The first and second slanting portions 31'*c* and 31'*d* and the third slanting portions 31'*e* cross each other in an X shape. For the first slanting portion 31'*c* and second slanting portion 31'*c*, tension member 30' for absorbing the elongation and slack of the wire by appropriately tensioning the entire wire.

At the vertical middle portions of the front moving portion 31'*a* and rear moving portion 31*b'*, a carrier plate 38' for supporting the door glass 10' is fixed so as to be almost horizontal. A U-shaped glass receiving member 41' is fixed to the carrier plate 38'.

As a means for fixing the wire 31'*a* to the carrier plate 38', as shown in FIG. 9(B) and FIG. 9(C), the wire 31'*a* is inserted into a hole made at a carrier plate attaching location 39', and fixed by means of an optional method such as caulking.

The end portion of the first slanting portion 31'*c* is latched on the drive pulley 25', and a length that allows the lifting and lowering stroke of the door glass 10' is wound around the drive pulley 25'. The end portion of the second slanting portion 31'*d* is also latched on the drive pulley 25', and the length that allows the lifting and lowering stroke of the door glass 10' is wound in a multi-round spiral groove 25'*a* of the drive pulley 25'.

Therefore, when the drive pulley 25' rotates clockwise, the first slanting portion 31'*c* of the wire is extended from the drive pulley 25', and the second slanting portion 31'*d* is wound by the drive pulley 25', and the moving portions 31'*a* and 31'*b* simultaneously rise. In accordance with this rise, the carrier plate 38' and door glass 10' lower together. Furthermore, when the drive pulley 25' rotates counterclockwise, the first and second slanting portions and the moving portions move oppositely to each other, whereby the carrier plate 38' and door glass 10' rise.

Next, the well-known tension member shown in FIG. 10 (referred to as a tensioner, also) is described in detail. The tensioner 30' comprises a swing member 60', a first slide member 61', and a second slide member 62'. These members are, as generally known, integrally plastically formed from a synthetic resin such as nylon or polyacetal which enables easy sliding but does not allow the occurrence of sliding noises.

The swing member 60' integrally connects the first slide member 61' and second slide member 62' while leaving a gap 63' that serves as a passage for the wire 33' therebetween. The swing member 60' is pivotally attached to the base panel 21' so that pendulum-like horizontal reciprocative movements of the second slide member 62' of the tensioner 30' are possible. A fixing hole 65' is formed in the base panel 21', a through hole 66' is formed in a hollow portion 61'*d* in the first slide member 61', and a pivot 64' is formed of a caulking pin for pivotally attaching the first slide member 61' to the base panel 21'.

A wound spring 70' is housed in a hollow portion 61'*e* of a lower opening formed in the body of the first slide member 61', one end thereof is inserted and fixed into a spring end fixing hole formed at an upper side of the body, an other end is inserted and fixed into a spring end fixing hole formed in the base panel 21', and the wound spring is constructed so as to absorb the slack that may be generated from the wire 33' by always pressing the second slide member 62' in one direction.

Circumferential surfaces opposed to the wire 33' passing through the wire passage 63' between the first slide member 61' and second slide member 62' are shaped as shown in the figure so as to have U-shaped sections opening outward. These first slide surface 61'*a* and second slide surface 62'*a* which have U-shaped sections opening outward are provided with brim portions 61'*b* and 62'*b* at both sides to guide the passing wire at a central flat portion.

The first slide member 61' and second slide member 62' are constructed so that, when the wire 33' passes through the wire passage 63' between the first slide member 61' and second slide member 62', the wire reciprocates toward an arrow 90' direction while being always guided by the flat surfaces 61'*a* and 62'*b* formed on the circumferential surfaces of the first slide member 61' and second slide member 62' in a case where the movement locus of the wire 33' advancing and retreating between the drum 25' and pulley 27' deflects in an axial direction (arrow 90' direction) of the drum 25' as shown in FIG. 10 in accordance with the rotation of the drum 25' which has the abovementioned spiral groove 25'*a*.

In the condition of FIG. 9, as mentioned above, when the drive pulley 25' is rotated clockwise to lower the door glass 10', the second slanting portion 31'*d* of the wire is strongly tensioned, and a slightly slackening condition is applied to the first slanting portion 31'*c* of the wire.

Particularly, when the drive pulley 25' is driven clockwise (counterclockwise) to lower (raise) the door glass 10' via the wire 33', even if the door glass 10' reaches a bottom dead point 10'*d* (top dead point 10'*c*) and stops, the drive pulley 25' continues to slightly rotate, and extends the first slanting portion 31'*c* (second slanting portion 31'*d*) of the wire. In such a condition, the second slide member 62' in the tension member 30' pulls and tensions the first slanting portion 31'*c* (second slanting portion 31'*d*) of the wire that is about to rotate in an arrow 59' direction and slacken, and absorbs the slack.

In the conventional vehicle door, the glass plate 10' is supported by elastic members provided in the grooves of two front and rear sashes 6'*a* and 6'*b* of the window frame when the glass plate has risen halfway or has entirely risen.

Therefore, at a moment at which the door 1' is closed with great force and it hits against the frame edge of the getting in/out section, in both cases of a hinge door and slide door, the glass plate 10' warps toward the inside of the vehicle due to inertia or shifts toward the inside of the vehicle while collapsing the elastic members (blades) in the sashes, and the lower portion of the glass plate 10' comes into contact with the internal components arranged in the space 4' of the panel 3'. Thereby, there was a problem that an impact noise occurred.

In order to solve the above mentioned problem, there is a conventional vehicle door 1' constructed so that an additional guide rail is provided at the middle position between the sashes 6'*a* and 6'*b* that are two front and rear guide rails within the panel 3' of the door 1', these three rails support the glass plate 10', and the glass plate 10' moves up and down while being supported by the rails.

With this construction, door stability when it is closed is improved. However, during use, resistive loads of the three rails are applied to upward and downward movements of the glass plate 10'. Due to the sliding resistance, upward and downward movements of the glass plate become entirely heavy. Therefore, there is a problem that the drive unit is required to output a high output, so that the drive unit is increased in size.

Furthermore, it becomes necessary to match the third rail with the movement locus of the glass plate. That is, it requires high-level techniques to form a guide surface on the third rail in contact with the movement locus of the glass at the middle position between the two front and rear guide rails in accordance with the movement locus of the glass plate which is determined by the sashes 6'*a* and 6'*b* serving as the two front and rear guide rails in the window frame. This work involves personnel problems such that it becomes necessary to station a specially skilled person at the line of assembly of the door.

Furthermore, if the skill of a worker is poor, the guide surface of the guide rail added at the middle position between the two front and rear guide rails may not match with the movement locus of the glass plate, and when the glass plate is moved up and down, there is a problem that the glass plate may creak or the movement thereof may become heavy or difficult.

Furthermore, in a case where the window 5' of the conventional door is large, the door glass 10' must have dimensions adapted to the window 5'. In accordance with this, the moving up and down stroke of the carrier plate 38' supporting the glass must be increased. On the other hand, an interval between the upper and lower pulleys 26' and 27' supporting the wire 31'*a* in the drive unit 20' provided at the panel 3' is set within a limited range in the internal space of the panel 3'.

Therefore, when increasing the stroke of the carrier plate 38' between the upper and lower pulleys, the top dead point (bottom dead point) of the carrier plate 38' comes closer to the pulley.

When the carrier plate 38' comes closer to the pulley 26', and in a case where the door is opened and closed, if the lower end of the glass 10' supported by the elastic blades repeatedly deflects toward a vehicle inward direction 73' and a vehicle outward direction 73" as shown in FIG. 9(C), a bending force with a large angle of bending 56' is repeatedly applied to the fastening point 39' of the wire 31'*a* to the carrier plate 38'. Therefore, there is a problem that cutting of the wire 31'*a* at the fastening point 39' occurs.

In order to avoid this problem, a method in which the top dead point (bottom dead point) of the carrier plate 38' is prevented from coming closer to the pulley 26' can be considered, however, in this case, the moving up and down stroke of the carrier plate 38' is further reduced, and it becomes necessary to make the window smaller.

Furthermore, in the conventional vehicle door, the first slide surface 61'*a* and second slide surface 62'*a* of the tension member 30' are formed to be flat as shown in FIG. 10.

Therefore, in response to the rotation of the drum 25' having the above mentioned spiral groove 25'*a*, the movement locus of the wire 33' advancing and retreating between the drum 25' and pulley deflects in the axial direction (arrow 90' direction) of the drum 25', whereby the first slide surface 61'*a* and second slide surface 62'*a* evenly reciprocatively slide toward the axial core direction (in the arrow 90' direction).

Thereby, the slide surfaces are evenly worn, and this makes use possible over an extended period of time.

However, in accordance with increases in the number of upward and downward movements of the glass plate 10' due to a long period of use, the first slide surface 61'*a* and second slide surface 62'*a* may be partially severely worn. In such a case, the worn portions are locally depressed, and the wire 33' that reciprocates in the arrow 90' direction in FIG. 10(B) and FIG. 10(C) is entangled in the depressed portions. Then, in accordance with increases in a depth of the depressions, when the wire slips out depressions, a snapping noise occurs. There is a problem that the driver of the vehicle mistakes the snapping noise for an abnormal noise and becomes concerned.

BRIEF SUMMARY OF THE INVENTION

The present invention provides a vehicle door for solving the above mentioned problems in the prior art.

An object of the invention is to provide a vehicle door in which a door glass plate can be moved up and down in a stable locus by guiding the door glass plate with two front and rear guide rails.

Another object of the invention is to provide a vehicle door in which a door glass plate can be lightly moved up and down with a smaller sliding resistance by guiding it with two front and rear guide rails which are provided for guiding the glass plate, and this reduces the output of a drive unit.

Still another object of the invention is to provide a vehicle door the assembly of which is easier than in a conventional case where one additional guide rail is accurately provided at the middle position between the two front and rear guide rails in accordance with the movement locus of the glass plate.

Still another object of the invention is to provide a vehicle door in which, even while employing a construction in which a glass plate 10 is guided with two front and rear guide rails, when a door 1 is closed with strong force and hits against the frame edge and suddenly stops, and the glass plate 10 is about to warp toward the inside of the vehicle due to inertia, or the lower portion of the glass plate is about to move excessively toward the inside of the vehicle while collapsing elastic members (blades) in the guide rails, the warp of the glass plate 10 is minimized and occurrence of a large noise due to collision of the lower portion of the glass plate against internal components provided at the inner side of the vehicle in the space 4 of the panel is prevented, and furthermore, in the above mentioned condition, the warp of the glass plate 10 is minimized, whereby most of the space 4 of the panel 3 of the door 1 is effectively used and arrangement of a large internal component therein becomes possible.

Still another object of the invention is to provide a vehicle door in which the stroke of the carrier plate that moves together with a glass plate is increased in size so that the glass plate can move with a large stroke, and as a result, the wire fixing portion on the carrier plate comes closer to the pulley in a condition where the carrier plate is raised (lowered) to the top dead point (bottom dead point), and if the carrier plate deflects in vehicle inward and outward directions, a bending force is applied to the wire fixing portion on the carrier plate, however, even in such a condition, a risk of the wire cutting at the fixing portion is significantly lowered.

Still another object of the invention is to provide a vehicle door in which a risk of occurrence of noises at the slide surfaces due to horizontal deflections of the wire as in the prior art is eliminated by construction in that the wire passes along the bottoms of V-shaped grooves formed in the first slide member 61 and second slide member 62 and the wearing portions are reduced to only the bottoms of the grooves even when the wire repeatedly slides on first slide surface 61*a* and second slide surface 62*a* of the tensioner 30 and wears the surfaces in accordance with increases in the number of upward and downward movements of the glass plate 10.

Still another object of the invention is to provide a vehicle door in which the separating condition between a base panel and a first slide surface (V-shaped groove) 61*a* and second slide surface (V-shaped groove) 62*a* in a tensioner is set so that the wire sliding force is minimized, whereby wearing at the slide surfaces is significantly reduced, and the vehicle door can be used for an extended period of time.

Other objects and advantages will easily become clear by the accompanying drawings and related descriptions given below.

The following effects can be expected in the construction of the invention.

The invention has an advantage in that the glass plate 10 can be moved up and down in a stable movement locus by guiding the door glass plate 10 with the two front and rear guide rails 7 and 8.

Since the door glass plate is guided by a minimum number of guide plates, that is, two front and rear guide plates, the glass plate can be lightly moved up and down with small sliding resistance.

Thereby, the output from the drive unit is allowed to be small, and therefore, there is a merit that the drive unit can be small in size.

Furthermore, even while the construction in which the glass plate 10 is guided by two front and rear guide rails 7 and 8 is employed, in a condition where the glass plate 10 warps toward the vehicle inner side (in the arrow 57 direction) at the moment at which the door 1 is closed with strong force and suddenly stops, and the lower portion 12 of the glass plate is about to move excessively in a vehicle inward direction, the warp of the glass plate 10 is minimized, and there is a merit that occurrence of an impact noise due to collision of the lower portion 12 of the glass plate against internal components provided in the space 4*b* at the vehicle inner side within the panel 3 is prevented.

Furthermore, since the warp of the glass plate 10 is minimized, the limited space 4*b* at the vehicle inner side of the panel 3 of the door 1 can be widely and effectively used.

There is an effect that this enables the arrangement of large internal components and increases the freedom in layout of the internal components.

Furthermore, since the number of guide rails 7 and 8 for guiding the door glass plate is minimized, that is, 2 at the front and rear sides as mentioned above, in comparison with the prior art in which one more guide rail for stopping the glass deflection is accurately provided at the middle position between the two front and rear guide rails in accordance with the movement locus of the glass plate, there is an advantage that the assembly of the guide rails becomes easier, and machine-assembly becomes possible.

Furthermore, even while employing the construction provided with the glass plate deflection stopping means 49 as mentioned above, when the drive unit 20 is installed into the space 4 in the panel 3 of the door 1, a contact member 51 is provided on the lower portion of the glass plate 10, so that there is an advantage that the installation can be completed without extra manpower.

There is an effect that the above mentioned construction of the fixing portion 39 significantly reduces the risk of wire cutting at a local position even when the carrier plate is raised (lowered) to the top dead point (bottom dead point).

Based on these circumstances, the present invention involves usability in use with a glass plate which is provided in a large window and moves up and down at large strokes without the risk of wire cutting at the wire fixing portion 39.

Furthermore, even when the wire repeatedly slides on the first slide surface 61*a* and second slide surface 62*a* of the tensioner 30 in accordance with increases in the number of upward and downward movements of the glass plate 10 and successively wears them, there is a merit that the wearing portions are only at the groove bottoms. This eliminates the risk of occurrence of an abnormal noise as in the prior art due to wire deflection at the slide surfaces, and prevents the driver from becoming concerned due to an abnormal noise. Furthermore, a position at which the wire sliding force on the slide surfaces is significantly reduced is selected, whereby there is an effect that the degree of wearing is reduced and it becomes possible to lengthen the life of the vehicle door and use the vehicle door for a long time.

DETAILED DESCRIPTION OF THE PREFERRED EMBODIMENT

Figure 9A:
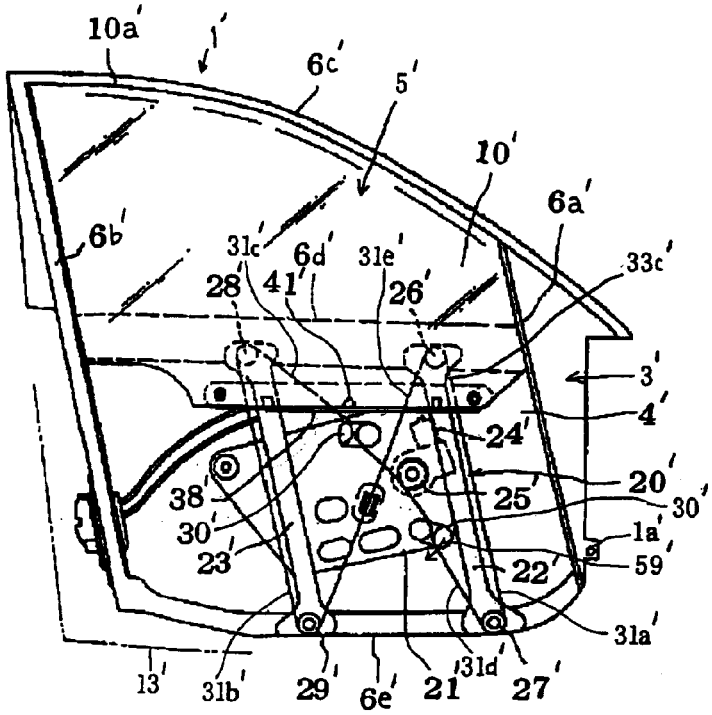
FIG. 9(A) BACKGROUND ART
FIG. 9(A) is an explanatory side view viewed from the outside of a vehicle, which shows a relationship among a door window frame, glass plate, and a drive unit of a conventional vehicle door.
Figure 9B:
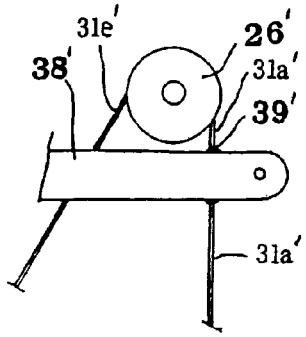
FIG. 9(B) is a partially enlarged view, including partial omission, for explanation of a relationship among the pulley, carrier plate at the top dead point, wire existing between the pulley and carrier plate in the conventional vehicle door, and a wire fixing portion.
Figure 9C:
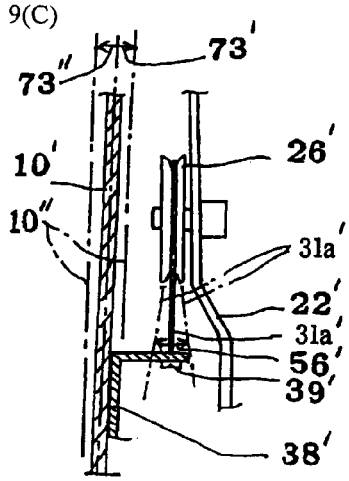
BACKGROUND ART FIG. 9(C)
FIG. 9(C) is a partially enlarged view, including partial omission, for explanation of a relationship among the pulley, carrier plate at the top dead point, and wire existing between the pulley and carrier plate.
Figure 10A:
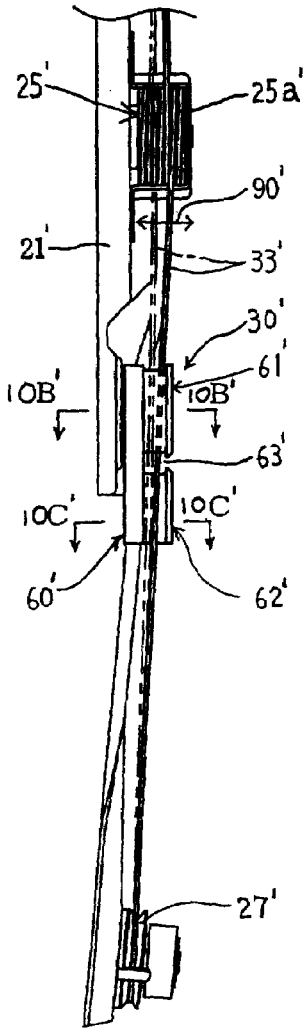
FIG. 10(A) is an explanatory view showing a relationship among a drum 25 having a spiral groove 25*a*, a tensioner 30, a pulley 27, and a wire 33 laid across them.
Figure 10B:
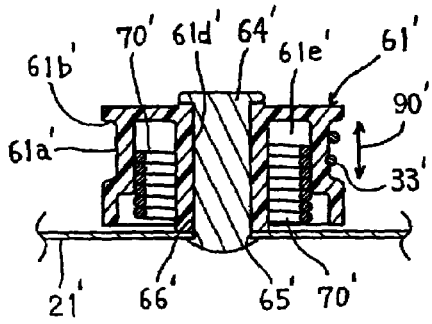
BACKGROUND ART FIG. 10(B)
FIG. 10(B) is a sectional view along the 10B-10B line of FIG. 10(A)
Figure 10C:
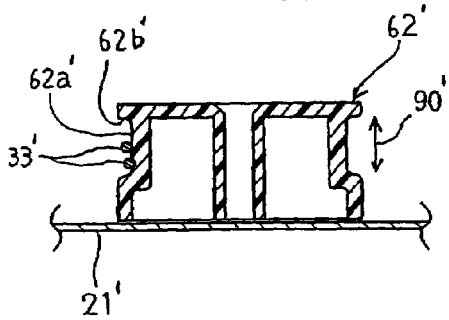
BACKGROUND ART FIG. 10(C)
FIG. 10(C) is a sectional view along the 10C-10C line of FIG. 10(A).

FIG. 1 through FIG. 8 showing embodiments of the present invention will be described hereinafter. In the description of FIG. 1 through FIG. 8, constructions, functions of components, characteristics, and features using the same reference symbols as in FIG. 9 and FIG. 10 that describe the above mentioned prior art can be understood as the same as in the above description except for matters relating to component constructions and combinations to be described later, so that an overlapping description shall be partially omitted.

In FIG. 1 through FIG. 8, a door 1 is constructed so that a forward end 1*a* is pivotally attached to a getting in/out section of a vehicle, and an other end 1*b* is formed to be rotatable horizontally.

An upper side in the door 1 shows a window 5, and a portion below the window shows a panel 3. The panel 3 comprises a middle frame 6*d* and a lower frame 6*e*, and a space 4 between the frames.

Figure 3A:
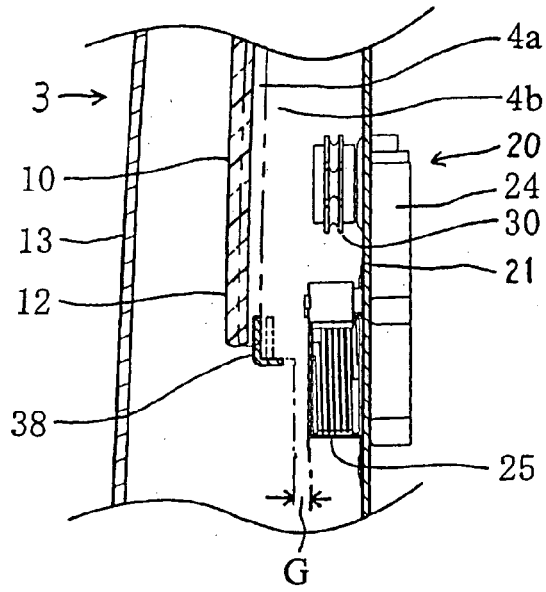
FIG. 3(A) is a sectional view along the 3A-3A line of FIG. 1.
Figure 3B:
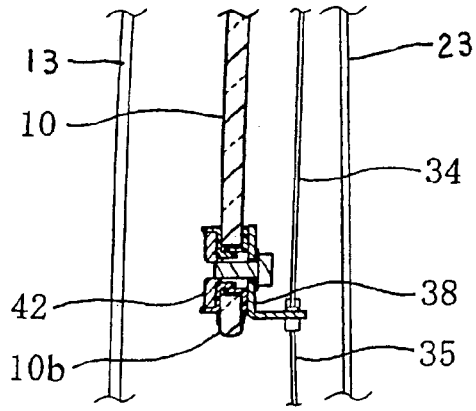
FIG. 3(B) is a sectional view along the 3B-3B line of FIG. 1.
Figure 3C:
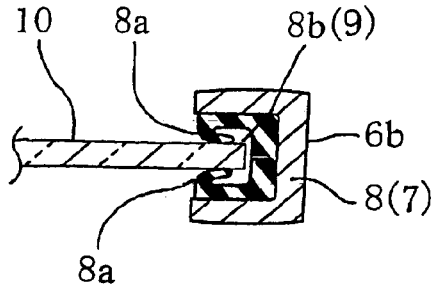
FIG. 3(C) is a sectional view along the 3C-3C line of FIG. 1.

In the window 5, a window frame 6 is surrounded by a front frame 6*a*, rear frame 6*b*, upper frame 6*c*, and middle frame 6*d*, which are respectively formed from a steel material as known. The front frame 6*a* and rear frame 6*b* are provided with a pair of guide rails 7 and 8 for guiding a glass plate 10. In the guide rails 7 and 8, guide grooves 8*b* which have U-shaped sections as shown in FIG. 3(C) are formed, and the glass plate 10 moves up and down along upward and downward locus 11 programmed for the glass plate 10. A receiving groove 9 which has a U-shaped section, for receiving the glass plate 10 is formed in the upper frame 6*c*. Each guide groove 8*b* positioned inside the guide rails 7 and 8 is surrounded by a member which is called a run channel and is formed from a comparatively hard and elastic material having a U-shaped section, as well-known example shown in FIG. 3(C). Blades 8*a* and 8*a* which have elasticity are formed inside the each run channel. A structure of a sectional portion of the receiving groove 9 in the upper frame 6*c* is made similarly as a structure of the guide groove 8*b* shown in FIG. 3(C).

Figure 1:
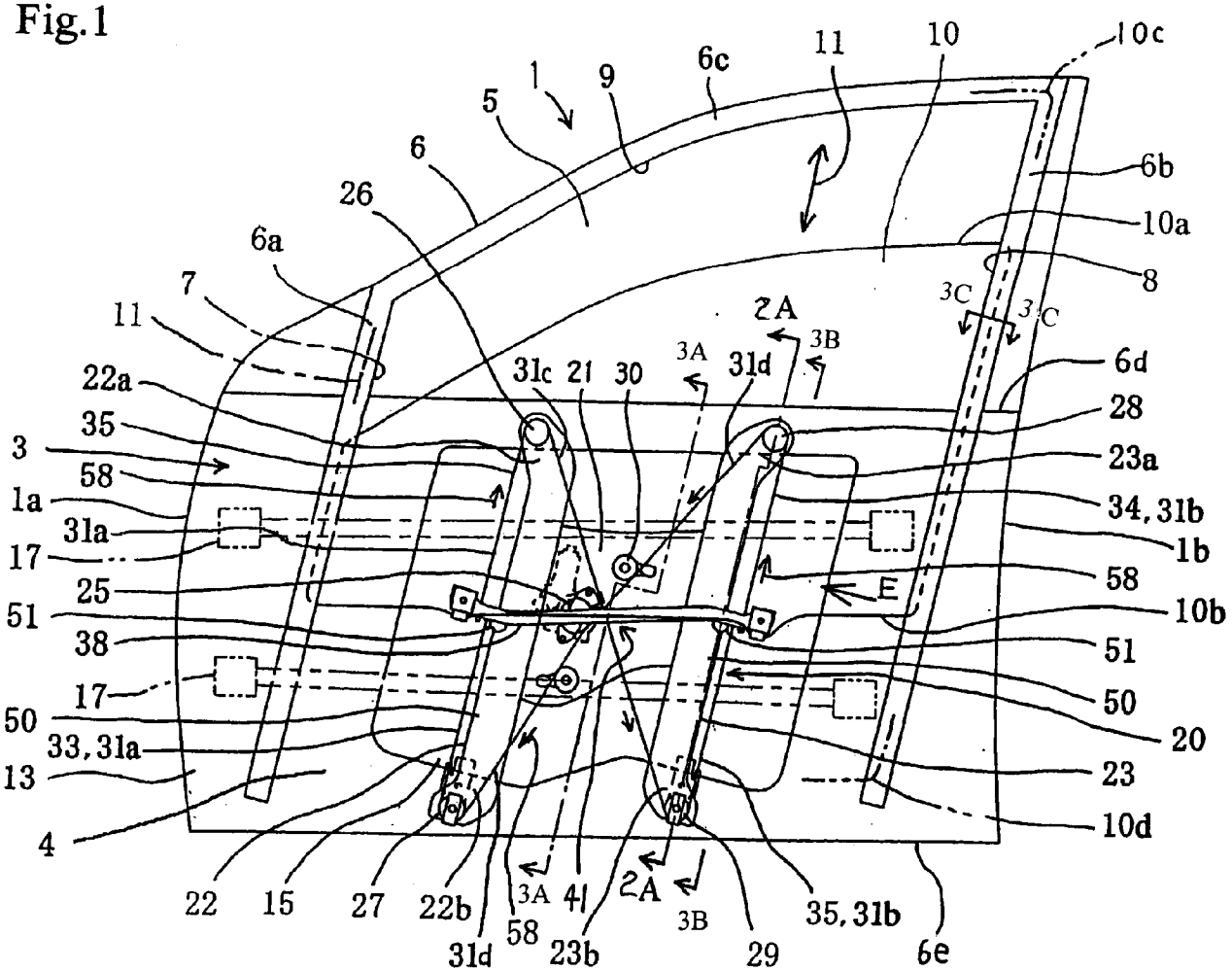
FIG. 1 is an explanatory side view showing a relationship among a window frame, glass plate, and drive unit of a vehicle door when being viewed from the outside of the vehicle.
Figure 2A:
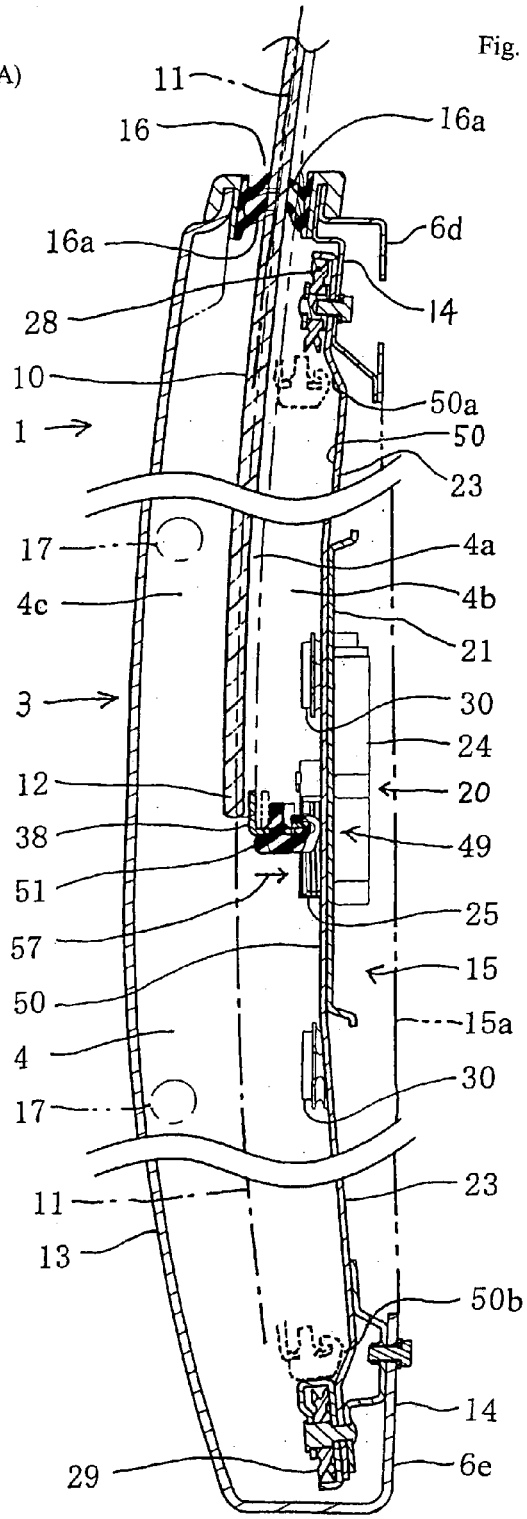
FIG. 2(A) is a sectional view along the 2A-2A line of FIG. 1.
Figure 2B:
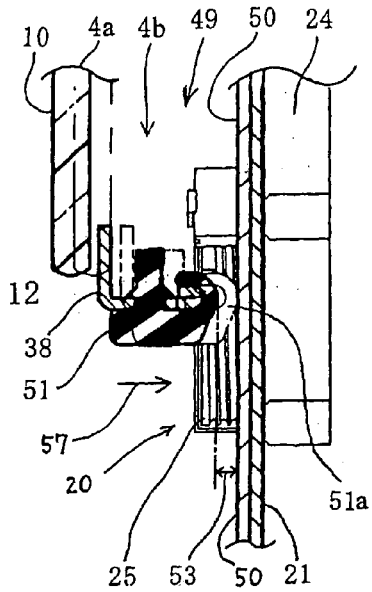
FIG. 2(B) is a partially enlarged view around a contact member of FIG. 2(A)

In the panel 3, the reference numeral 13 denotes an outer panel, and as visibly shown in FIG. 2, the reference numerals 14 and 15 denote an inner frame connected to the outer panel 13 and a through hole for working, respectively, and they are normally covered by a detachable panel (provided at a position shown by a two-dot chain line). In the space 4, the reference numeral 4*a* denotes a glass housing space, 4*b* denotes a space closer to the inside of the vehicle than the glass housing space, and 4*c* denotes a space closer to the outside of the vehicle for providing an impact bar 17, etc. A glass entrance 16 is formed at the middle frame 6*d*, and blades 16*a* of a belt line mall, which are formed from an elastic material such as rubber, are arranged at both sides of the glass entrance.

The above mentioned door 1 is constructed so that, in a rising condition where an upper portion 10*a* of the glass plate 10 that is movable up and down enters the receiving groove 9 and reaches the top dead point 10*c*, the glass plate 10 closes the window 5 in the door 1, and in a lowering condition where a lower portion 10*b* of the glass plate 10 reaches a bottom dead point 10*d*, the glass plate 10 is housed in the glass plate housing space 4*a* of the door 1.

In a drive unit 20 which is provided in the space 4 of the panel 3 and has a well-known construction for driving the glass plate 10 up and down, a base panel 21 comprises a plate main body and stays 22 and 23 integrally connected to both sides, which are formed from a steel material. Upper and lower portions 22*a*, 22*b*, 23*a*, and 23*b* of the stays are attached to an inner frame 14 with bolts in a detachable manner.

A wire driving drum 25 is mounted to the main body of the base panel 21, and on the other hand, pulleys 26, 27, 28, and 29 are provided at the upper and lower portions 22*a*, 22*b*, 23*a*, and 23*b* of the stays 22 and 23, respectively.

Wires 33, 34, and 35 are set on the above mentioned pulleys as shown in the figure.

A motor 24 drives the drum 25. However, as is conventional, it is also possible that the drum 25 is driven by a well-known manual handle.

To support the lower portion of the glass plate 10, the drive unit 20 has a carrier plate 38 formed from a well-known hard material. One end of the wire 33 and one end of the wire 35 are fixed to one end of the carrier plate 38, and one end of the wire 34 and an other end of the wire 35 are fixed to an other end of the carrier plate. Other ends of the wire 33 and wire 34 are independently fixed to both sides of the drum 25 that has 5 to 7-round spiral wire grooves. The positional relationship and setting conditions of the drive motor 24, wire driving drum 25, pulleys 26, 27, 28, and 29, carrier plate 38, and wires 33, 34, and 35 are set as is conventional, that is, the drum 25 turns in one direction by rotating the motor 24 in one direction, and for example, the wires 33, 34, and 35 move in an arrow 58 direction, whereby the carrier plate 38 is raised. When the motor is reversed, the wires move in an opposite direction, whereby the carrier plate is lowered.

On the carrier plate 38, the lower end 10*b* of the glass plate 10 is received by a hook member as in the case with a conventional glass receiver 41 (the hook member exists at a location of an arrow 41 in FIG. 1, however, it is not shown in the figure), and the glass plate 10 is fixed to both sides 38*b* of the carrier plate 38 via an optional member 42 such as a glass holder in a detachable manner so that the glass plate-10 can integrally move up and down.

Figure 4A:
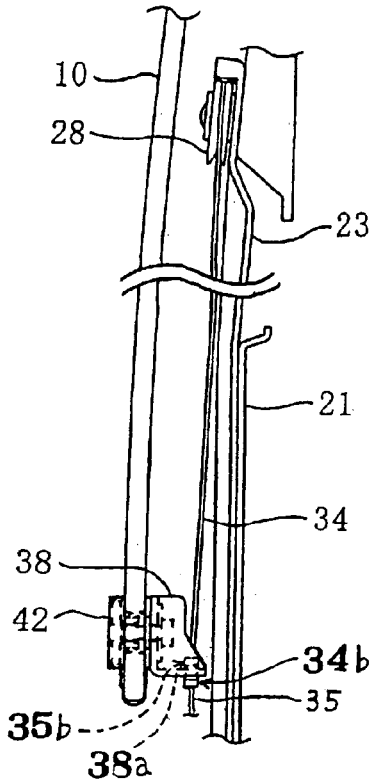
FIG. 4(A) is a partially omitted view which is viewed from the E direction, as shown in FIG. 1, in order to explain a condition where the carrier plate is hung with a wire at the lower portion of the glass plate.
Figure 4B:
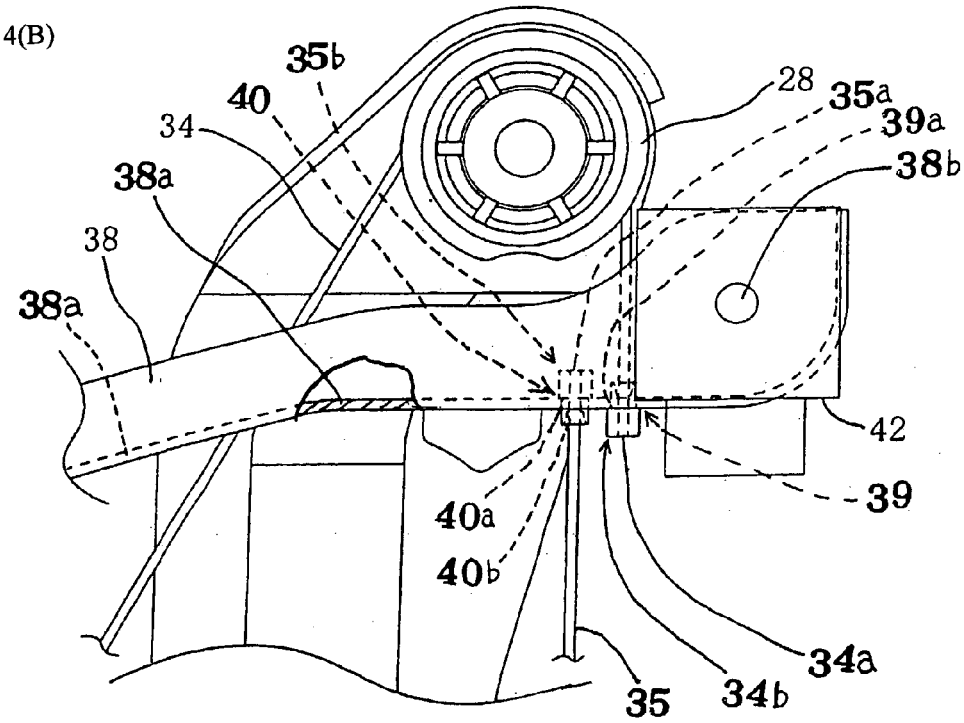
FIG. 4(B) is a drawing showing the positional relationship among a pulley, a carrier plate at the top dead point, a contact member, a supporting rod, and a wire fixing position.

The carrier plate 38 is connected to the lower portion of the glass plate 10 so as to support it, and as clearly shown in FIG. 4 and FIG. 5, projections 38*a* are formed at front and rear ends of the carrier plate. One end of the wire 33 and one end of the wire 35 are fixed to the front end side, and one end of the wire 34 and the other end of the wire 35 are fixed to the rear end side of the carrier plate. Furthermore, as is conventional, the other ends of the wire 33 and wire 34 are independently fixed to both sides of the drum 25 provided with 5 to 7-round spiral wire grooves.

At the wire fixing portions 39 and 40 provided at the projection 38*a* at the rear end of the carrier plate 38, through holes 39*a* and 40*a* are formed in upward and downward directions with respect to the projection 38*a*. In these holes, wire free ends 34*a* and 35*a* are penetrated, and at the penetrated wire free end sides, stopper members 34*b* and 35*b* having larger diameters than that of the wires are fixed. As a fixing means, an optional well-known means may be used. For example, the stopper members 34*b* and 35*b* are provided at the edges of the through holes in advance, the wires are inserted into the holes and sandwiched by the stopper members 34*b* and 35*b*, and then the stopper members are collapsed, and due to the plastic deformation, the wires and stopper members are integrated with each other. Furthermore, at portions of the stopper members 34*b* and 35*b* exposed from the through holes 39*a* and 40*a*, that is, at portions opposed to the pulleys 28 and 29, trumpet-shaped guide portions 39*b* and 40*b* (funnel-shaped so as to have upward expanding curved surfaces like a morning-glory) are formed in a condition where the wires are positioned at the center.

Figure 5A:
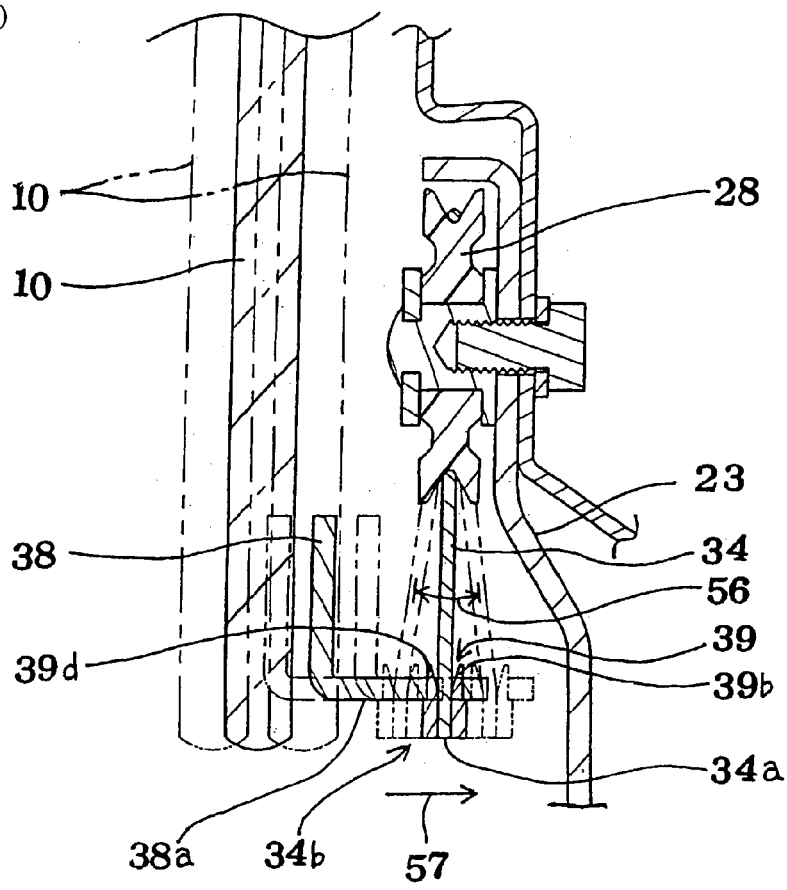
FIG. 5(A) is a partially enlarged view, including partial omission, for explanation of a relationship among a pulley, a carrier plate at the top dead point, and a wire existing between the pulley and carrier plate.

As shown in FIG. 5(A), the angular aperture of the above mentioned funnel shapes may be adapted to the deflection angles 56 of the wires, which are caused by a movement width of the carrier plate 38 at the top dead point toward the inside of the vehicle with respect to the pulley 28 that is provided to be unmovable toward the inside of the vehicle. Namely, in FIG. 5(A), the only requirement is that, in the process in which the horizontal deflection angles 56 of the wires become maximum, both curved side surfaces formed on the upper portion of the stopper member 34*b* come into contact with the wire circumferential surfaces from the under side in order.

Figure 5B:
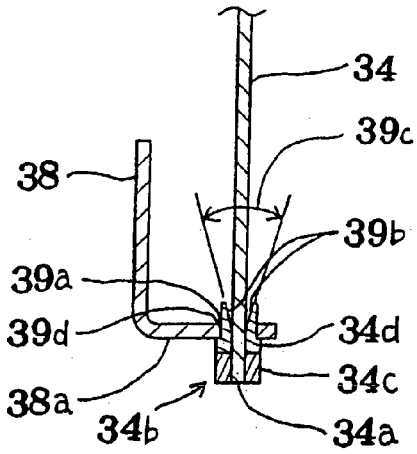
FIG. 5(B) is a partially enlarged view including partial omission, which shows another example of a stopper member 34*b*.

The stopper member 34*b* may be constructed as shown in FIG. 5(A), however, as shown in FIG. 5(B), the stopper member may be constructed so that the stopper member is divided into a member 34*c* to be fixed to the wire and a member 34*d* for forming the guide portion, and a trumpet-shaped guide portion 39*b* having an angular aperture 39*c* is formed on the member 34*d* of the stopper member 34*b*.

Figure 5C:
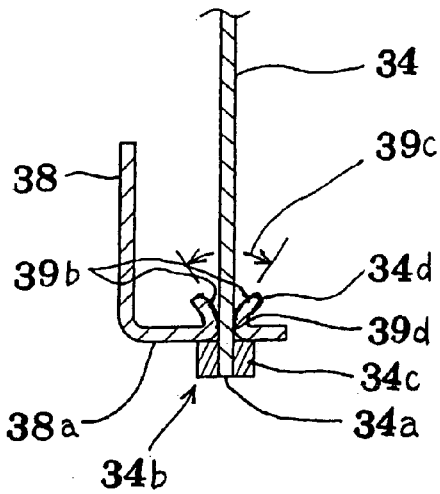
FIG. 5(C) is a partially enlarged view including partial omission, which shows still another example of the stopper member 34*b;*

Furthermore, as shown in FIG. 5(C), it is also possible that the member 34*b* is constructed so that the member 34*b* is divided into a member 34*c* to be fixed to the wire and a member 34*d* for forming the guide portion, and the member 34*b* for forming the guide portion 39*b* is formed into a trumpet shape having an angular aperture 39*c* by applying burring to a circumferential edge of the through hole 39*a* at the projection 38*a* of the carrier plate 38, whereby this edge is formed as the guide portion 39*b*.

When the curved glass plate 10 (see FIG. 2) moves up and down along curved surfaces of the guide rails 7 and 8, the locus of the carrier plate 38 with respect to the pulley 28 gently changes in vehicle inward or outward direction. Thereby, the wire fixing portions 39 move forward and rearward in the vehicle inward and outward directions with respect to the pulley 28, and the wire 34 deflects in the vehicle inward and outward directions at a deflection angle 56.

Even when the wire repeatedly deflects in the vehicle inward and outward directions due to repetition of such upward and downward movements of the glass plate, the construction relating to the guide portion 39*b* is useful for preventing the wire from being broken due to repeated metal fatigue.

Next, when it is desired that the carrier plate 38 is brought closer to the upper pulley 28, the wire fixing portion on the carrier plate 38 may be constructed so that the projecting member 38*a* directed sideward is formed at a lower position of the carrier plate 38 to make the fixing portion 39 distant from the pulley 28 positioned at the upper side, and on the projecting member 38*a*, the wire fixing portion 39 along the upper pulley 28 is formed.

This is useful for suppressing the deflection angle 56 of the wire since the gap between the pulley 28 and the wire fixing portion 39 becomes comparatively wide even when the carrier plate 38 is brought closer to the upper pulley 28.

With this construction, when the carrier plate 38 is at the bottom dead point, a problem that the wire fixing portion 40 approaches the lower pulley 29 occurs. However, in an age in which air conditioning equipment including air-conditioned vehicles has become spread, the door opening and closing frequency in the window closing condition (at the upper dead point) is extremely high in comparison with the frequency in the window opening condition (at the bottom dead point).

Therefore, the possibility that the wire is cut by deflection of the carrier plate 38 at the bottom dead point is extremely low, and a countermeasure for preventing cutting at the wire fixing portion due to deflection of the carrier plate 38 at the top dead point is more important than the wire cutting possibility at the bottom dead point. Therefore, the above mentioned construction is useful based on these circumstances.

Figure 2C:
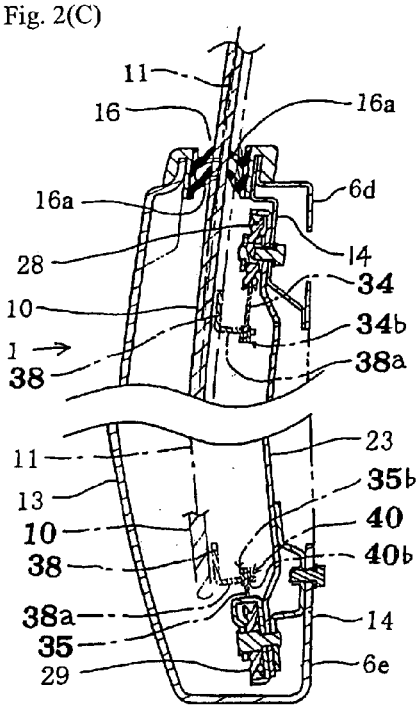
FIG. 2(C) is a sectional view along the 2A-2A line of FIG. 1 showing a condition where a carrier plate is at the top dead point or bottom dead point.

Thus, when the glass plate 10 is moved up and down with large strokes, the carrier plate 38 for supporting the glass plate, which moves with this glass plate, must be operated by using the entire region between the upper and lower pulleys 28 and 29 supporting the wires (see FIG. 2(C)). However, in this case, in a condition where the carrier plate is raised (lowered) to the top dead point (bottom dead point), the wire fixing portion 39 on the carrier plate approaches the pulleys. If the carrier plate 38 deflects in the vehicle inward and outward directions in this approaching condition, a bending force is applied to a local portion of the wire fixing portion 39 on the carrier plate, and at this fixing portion, there is a possibility that the wire is cut due to this fixing portion 39.

Even under such a circumstance, the through hole is formed in the wire fixing portion 39 on the carrier plate, the wire free end along the pulley is penetrated through the hole, and the wire stopper member is fixed to the free end, and in a condition where the penetrating wire is positioned at the center, trumpet-shaped guide portion 39*b* whose diameter is increased at the pulley side is formed on the hole edge 39*d* at the pulley side of the through hole 39*a*, so that a special effect can be obtained in that even under the above mentioned circumstance, the risk of wire cutting at a local position can be significantly reduced at the fixing portion 39.

As mentioned above, the present invention has excellent usability, wherein use with a glass plate to be moved up and down with large strokes at the large window is possible while there is no risk of wire cutting at the wire fixing portion 39.

As mentioned above, the construction relationship between the pulley 28 and the fixing portion 39 of the wire 34 at the rear end side of the carrier plate 38 has been mainly described. However, a relationship between the pulley 29 and the fixing portion 40 of the wire 35, a relationship between the pulley 26 and the fixing portion of the wire 35, and a relationship between the pulley 27 and the fixing portion of the wire 33 are understood as the same as the above mentioned relationship between the pulley 28 and the fixing portion 39 of the wire 34, so that an overlapping description thereof is omitted.

Next, in the space 4, a glass plate deflection stopping means 49 (see FIG. 2) comprising a supporting rod 50 and a contact member 51 is provided so as not to substantially involve loads with upward and downward movements of the glass plate 10 in normal conditions. However, the glass plate deflection stopping means is constructed so that, when a pressure is applied to the glass plate 10 toward a vehicle inward direction 57, the glass plate 10 endures the pressure without moving and collapsing the blades 8*a* and 16*a* at the run channels, or the glass plate itself is prevented from bending.

In the deflection stopping means 49, the supporting rod 50 is provided at the further inner side 4*b* (arrow 57 direction) of the vehicle than the upward and downward movement locus 11 of the glass plate 10, and in the vertical direction along the upward and downward movement locus 11 of the glass plate 10. In this embodiment, surfaces of one or two of the stays 22 and 23 at both sides of the base panel 21 are formed into curved surfaces in accordance with the curved upward and downward locus 11 of the glass plate 10, and the surfaces are used as supporting rods. However, it is also possible that an independent vertically long member is positioned adjacent to the stay 22 and fixed to the base panel 21.

Next, the contact member 51 provided at the lower portion of the glass plate 10 is detachably attached to, for example, the lower end of the glass plate 10 or the carrier plate 38 for unification with the glass plate 10 by an optional attaching means such as adhesion so that the contact member moves up and down together with the glass plate 10 while securing a gap 53 for preventing contact with the supporting rod 50 in normal conditions. A sound absorbing material, for example, hard rubber or synthetic resin, which prevents a large noise when the contact member 51 comes into contact with the supporting rod 50, may be used as a material for the contact member 51.

The above mentioned gap 53 is determined as follows. The door 1 is closed with great force in the direction of the arrow 57, and at the moment at which the door hits against an edge of the getting in/out section, the lower portion 12 of the glass plate 10 is about to move excessively in the vehicle inward direction (arrow 57 direction) due to inertia. If this condition remains, the lower portion 12 of the glass plate 10 moves excessively in the vehicle inward direction, hits against the internal components (for example, the drum 25) of FIG. 3(A), and causes an impact noise.

However, in this embodiment, when the lower portion is about to move excessively in the vehicle inward direction, the contact member 51 moves to a position shown by the reference numeral 51*a*, and the gap 53 becomes naught, a tip end of the contact member 51 comes into contact with the supporting rod 50 and is softly received, whereby the excessive movement of the lower portion 12 of the glass plate 10 is prevented. In this case, as shown in FIG. 3(A), a gap G is left between the carrier plate 38 at the lower portion 12 of the glass plate 10 and the internal components (for example, the drum 25), whereby occurrence of an impact noise is prevented.

The above mentioned gap 53 may be formed into an optional size (for example, 5 mm through 10 mm) suitable for the above mentioned shock preventive action although it depends on the elasticity of the contact member 51.

On the other hand, in conditions where the glass plate 10 reaches the top dead point 10*c* and bottom dead point 10*d*, it is preferable that the deflection in the vehicle inward direction is reduced as small as possible.

In this case, the supporting rod 50 may be constructed so that the surface of the supporting rod is curved along the upward and downward movement locus 11 of the glass plate 10 as shown in FIG. 2(A). Thereby, the gap 53 in the case where the glass plate is at a top dead point corresponding position 50*a* (bottom dead point corresponding position 50*b*) can be made smaller than that in the case where the glass plate is at a middle position (shown by a solid line in FIG. 2(A)). The gap 53 when the glass plate is at the top and bottom positions is slight, and for example, may be set so that the contact member 51 comes into soft contact with the supporting rod 50. With the above mentioned construction, horizontal deflection can be nearly eliminated when the glass plate 10 reaches the top dead point 10*c* and bottom dead point 10*d*.

With the above mentioned construction, when the drive unit 20 is installed into the space 4 in the panel 3, even when the glass plate deflection stopping means 49 is provided as mentioned above, the contact member 51 is unified with the carrier plate 38, and on the other hand, the supporting rod 50 is separately provided at the side of the stay, so that the contact member and the supporting rod are separated from each other, and their assembly becomes easier than in the case where the contact member and supporting rod 50 are integrated.

Furthermore, when the supporting rod is installed, since the surface of the supporting rod 50 is opposed to the contact member 51 at the lower portion of the glass plate 10 via the gap 53, even when there is a slight error of the gap 53 (even when the manufacturing accuracy of the supporting rod 50 is poor, and furthermore, even when the installation work is slightly rough and the gap accuracy is poor), the above mentioned functions are not influenced.

Figure 6A:
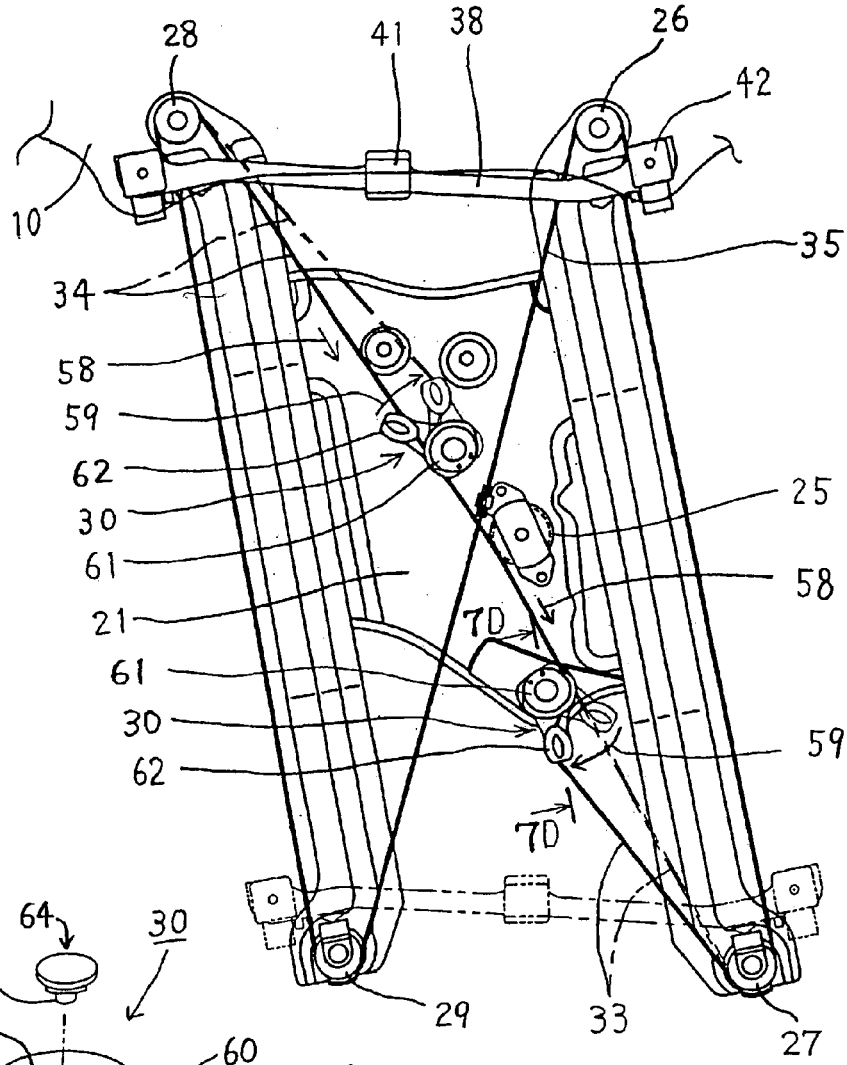
FIG. 6(A) is an explanatory view showing a relationship among a base panel, a pulley, a drum in a drive unit, a wire, and a tensioner.
Figure 6B:
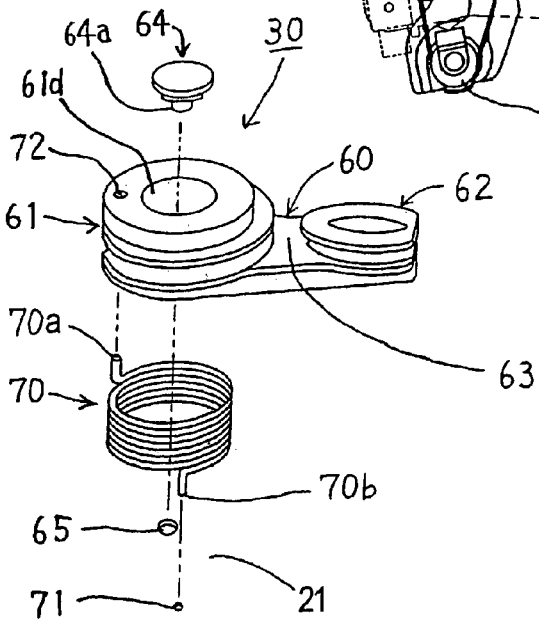
FIG. 6(B) is an exploded perspective view of the tensioner.
Figure 7:
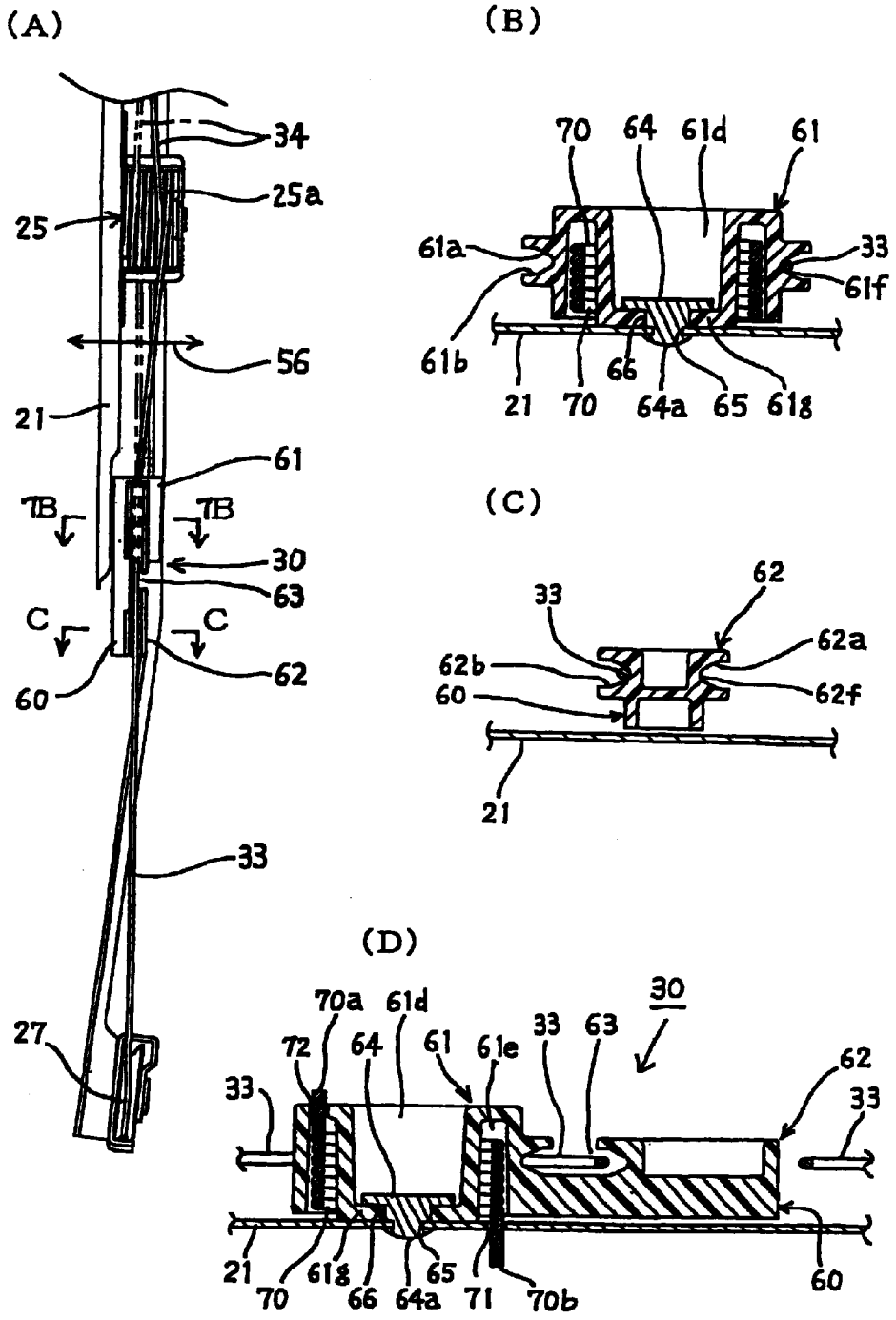
FIG. 7(A) is an explanatory view viewed from the left side, showing the relationship among a drum 25 having a spiral groove 25*a*, a tensioner 30, a pulley 27, and a wire 33 laid across the tensioner 30 and pulley 27 in FIG. 6(A)
FIG. 7(B) is a sectional view along the 7B-7B line of FIG. 7(A)
FIG. 7(C) is a sectional view along the 7C-7C line of FIG. 7(A)
FIG. 7(D) is a sectional view along the 7D-7D line of FIG. 6(A)
Figure 8:
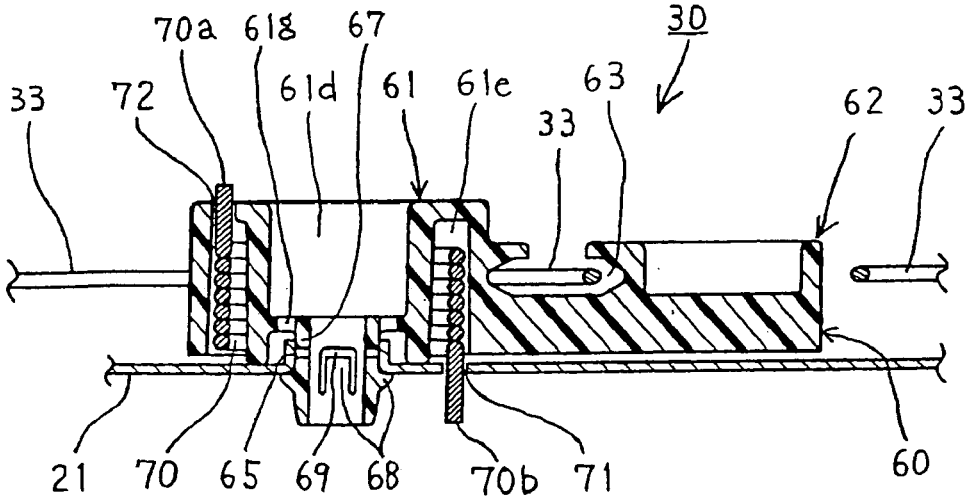
FIG. 8 is a sectional view of a tensioner which is different from that in FIG. 7(D)

Next, a tensioner 30 shown in FIG. 1 through FIG. 8 is described in detail (more details are shown in FIG. 6 through FIG. 8). The tensioner 30 comprises, as shown in FIG. 7, a swing member 60, a first slide member 61, and a second slide member 62. These members are integrally plastically formed from a synthetic resin, for example, nylon or polyacetal which enables easy sliding but does not allow occurrence of sliding noises.

The swing member 60 integrally connects the first slide member 61 and second slide member 62 so as to form a gap 63 as a passage for the wire therebetween. The swing member 60 is pivotally attached to the base panel 21 so that reciprocative pendulum-like movements of the second slide member 62 of the tensioner 30 shown in FIG. 6 to the right and left are possible. A fixing hole 65 (see FIG. 7) is made in the base panel 21, a through hole 66 is made in the bottom member 61*g* of a hollow portion 61*d* that opens upward and is formed in the first slide member 61, and a pivot 64 is formed of a caulking pin for pivotally attaching the first slide member 61 to the base panel 21.

FIG. 8 shows another example including a caulking pivot constructed differently from that in FIG. 7, wherein a cylindrical body 67 is projected from a bottom member 61*g*, and rotatably inserted into a fixing hole 65 of the base panel 21. A stopper claw 68 is provided so as to elastically bend in the radius direction by forming a gap 69 around the stopper claw.

A wound spring 70 is housed in a hollow portion 61*e* at a lower opening provided in a body of the first slide member 61, and one end 70*a* of the wound spring is inserted and fixed into a spring end fixing hole 72 made at an upper side of the body, and an other end 70*b* is inserted and fixed into a spring end fixing hole 71 made in the base panel 21, and the wound spring is constructed so that the spring always presses the second slide member 62 in an arrow 59 direction so as to always follow the movements of the wires 33 and 34 to absorb the slack that may generated from the wires 33 and 34.

Circumferential surfaces opposed to the wire 33 that is brought through the wire passage 63 between the first slide member 61 and second slide member 62 are formed so as to have almost V-shaped sections, respectively. A first slide surface (V-shaped groove) 61*a* and second slide surface (V-shaped groove) 62*a* having these V-shaped sections are provided with wire guide surfaces 61*b* and 62*b* which have inclines on both sides, and groove bottoms 61*f* and 62*f* which guide the passing wire at groove center deep portions.

The above mentioned first slide member 61 and second slide member 62 are constructed so that, even when the movement locus of the wire 33 advancing and retreating between the drum 25 and pulley 27 deflects in the axial direction (arrow 56 direction) of the drum 25 in accordance with rotation of the drum 25 which has the above mentioned spiral groove 25*a* as shown in FIG. 7(A), when the wire passes through the wire passage 63 between the first slide member 61 and second slide member 62, the wire 33 is always guided by the wire guide surfaces 61*b* and 62*b* that have inclines on both sides along the groove bottoms 61*f* and 62*f* formed in the circumferential surfaces of the first slide member 61 and second slide member 62. Therefore, over a long period of use, even when the wire reciprocates along the groove bottoms 61*f* and 62*f* formed in the circumferential surfaces of the first slide members 61 and second slide members 62 and wears these portions, there are substantially no changes in the basic groove shapes, whereby the wire can be prevented from jutting out due to horizontal deflection.

The condition of separation between the first slide surface (V-shaped groove) 61*a* and second slide surface (V-shaped groove) 62*a* of the tensioner 30 and the base panel in the arrow 56 direction in FIG. 7 may be set as follows. The movement locus of the wire 33 that is laid across the drum 25 and pulley reciprocatively changes with a fixed change width in the axial direction 56 of the drum 25 in accordance with the reciprocative rotation of the drum.

Therefore, the above mentioned condition of separation may be set so that the V-shaped grooves of the tensioner are positioned at positions slightly shifting from a center of the change widths toward the side at which the greatest tension is applied, for example, toward the left in the FIG. 7(A).

In the above mentioned tensioner, when the drum is rotated in the wire setting condition shown in FIG. 6(A) and the wire is moved in the arrow 58 direction to raise the glass plate, the wire is partially greatly tensioned, and a condition for slightly slackening the wire is partially applied to the wire. However, in such a condition, the second slide member 62 of the tensioner 30 rotates in the arrow 59 direction and tensions the wire that is about to slacken.

Particularly, when the drum 25 is rotated to raise (lower) the glass plate 10 via the wires 33, 34, and 35, even if the glass plate 10 reaches the top dead point 10*c* (bottom dead point 10*d*) and the movement of the glass plate 10 stops, there is a possibility that the drum 25 continues to slightly rotate and extends the wire 33 (34).

However, at this point, the tensioner 30 rotates and absorbs the slack that may be generated from the extended wire 33 (34), whereby an accident in that the wire 33 (34) comes off the pulley 27 (28) is prevented.

As many apparently widely different embodiments of this invention may be made without departing from the spirit and scope thereof, it is to be understood that the invention is not limited to the specific embodiments thereof except as defined in the appended claims.

The invention claimed is:

1. A vehicle door, comprising:

a window opening at an upper side of said vehicle door, a glass plate which is movable between an open position and a closed position, said glass plate closes said window opening when the glass plate is in said closed position and is housed inside a glass plate housing space within a lower side of said vehicle door when the glass plate is in said open position, guide rails are arranged at front and rear sides of the glass plate and guide the glass plate, and a drive unit is disposed inside the lower side of said vehicle door to drive said glass plate up and down, a base panel having a plurality of pulleys at upper and lower positions of said base panel for guiding wires for driving the glass plate up and down, said drive unit comprising a drum provided on the base panel for driving said wires, a carrier plate for moving up and down between the upper and lower pulleys while supporting a lower side of said glass plate, the wires engaging the plurality of pulleys, at least two of said wires partially wound around the drum and fixed to said carrier plate, a tensioner is disposed between at least one of the pulleys and the drum for tensioning one of the at least two of the wires to prevent said one of the at least two of the wires from slackening when said one of the at least two of the wires is being moved by rotating said drum to drive the carrier plate up and down, wherein said tensioner comprises a first slide member and a second slide member, wherein said first slide member and said second slide member are connected to each other and spaced apart by a gap which forms a passage for said one of the at least two of said wires;

the first slide member being pivotally attached to the base panel so that the second slide member can pivot relative to said base panel, said first slide member including a circumferential surface and said second slide member including a circumferential surface generally parallel to said circumferential surface of said first slide member, said circumferential surfaces defining said passage, each of the circumferential surfaces of said first and second slide members including a substantially V-shaped groove having a groove bottom, said groove bottoms of the first and second slide members engage said one of the at least two of said wires passing along the passage between said first slide member and second slide member, said drum including an axis and said one of the at least two of said wires moves a distance along said axis between a first end position corresponding to said open position of said glass plate and a second end position corresponding to said closed position of said glass plate as said one of the at least two of said wires is wound on and unwound from said drum, wherein the the substantially V-shaped grooves of the tensioner are shifted from a center of said distance toward a side of the tensioner to which the greatest tension is applied by said one of the at least two of said wires to reduce the wear on said one of the at least two of said wires.

2. The vehicle door of claim 1, wherein the second slide member pivots in a direction to tension said one of the at least two of said wires to prevent said one of the at least two of said wires from coming off said at least one of the plurality of pulleys.

* * * * *